US009433273B2

(12) United States Patent
Kock

(10) Patent No.: US 9,433,273 B2
(45) Date of Patent: Sep. 6, 2016

(54) HAIR STYLING DEVICE AND METHOD OF USE

(71) Applicant: WIK Far East Ltd., Hong Kong (CN)

(72) Inventor: Marwin Kock, Essen (DE)

(73) Assignee: WIK Far East Ltd., Hong Kong (CN)

( * ) Notice: Subject to any disclaimer, the term of this patent is extended or adjusted under 35 U.S.C. 154(b) by 0 days.

(21) Appl. No.: 14/465,207

(22) Filed: Aug. 21, 2014

(65) Prior Publication Data

US 2015/0237982 A1 Aug. 27, 2015

(30) Foreign Application Priority Data

Jul. 22, 2013 (DE) ..... 10 2013 107 778

(51) Int. Cl.
*A45D 7/02* (2006.01)
*A45D 7/00* (2006.01)
*A45D 1/04* (2006.01)

(52) U.S. Cl.
CPC . *A45D 7/02* (2013.01); *A45D 1/04* (2013.01); *A45D 7/00* (2013.01); *A45D 2007/002* (2013.01)

(58) Field of Classification Search
CPC ..... A45D 7/00; A45D 7/02; A45D 2007/002
USPC ..... 132/211, 210
See application file for complete search history.

(56) References Cited

U.S. PATENT DOCUMENTS 3,224,454 A * 12/1965 Quinio ..... A45D 1/04 132/118
4,166,473 A * 9/1979 Bauer ..... A45D 1/04 132/272
4,341,229 A * 7/1982 Bauer ..... A45D 1/04 132/204
5,868,146 A * 2/1999 Henninger ..... A45D 1/04 132/232
6,354,305 B1 * 3/2002 Janouch ..... A45D 7/02 132/207
7,096,598 B1 * 8/2006 Myatt ..... A45D 20/52 34/96
7,124,763 B2 10/2006 Hafemann
7,989,734 B2 * 8/2011 Lee ..... A45D 1/04 132/224
8,347,897 B2 * 1/2013 Benest ..... A45D 1/04 132/224
2010/0083978 A1 * 4/2010 Hottenrott ..... A45D 1/06 132/211
2012/0211018 A1 * 8/2012 deGrood ..... A45D 1/04 132/211
2012/0312320 A1 * 12/2012 Humphreys ..... A45D 1/04 132/211
2014/0238432 A1 8/2014 Deng
2014/0353301 A1 * 12/2014 Rizzuto ..... D06F 75/30 219/225

OTHER PUBLICATIONS

Wortman, et al., Dec. 15, 2005, Wiley InterScience, The Effect of Water on the Glass Transition of Human Hair, pp. 1-5.*

* cited by examiner

*Primary Examiner* — Tatiana Nobrega
(74) *Attorney, Agent, or Firm* — Polson Intellectual Property Law, PC; Margaret Polson

(57) ABSTRACT

A method of forming curls/waves of hair with a styling device having shaping surfaces of shaping plates and a device designed to perform said method are disclosed. The hair is heated until the sulfur bonds contained in the keratin chains are extensively broken. The heated hair is pulled past several spaced-apart shaping bodies, other while in contact with them. Upon contacting the first shaping body the hair has a temperature where the sulfur bonds are extensively broken, then, before leaving the last shaping body has cooled to where the sulfur bonds have largely rejoined.

The device comprises two hinged arms moving against each other, each having a shaping plate on its facing surfaces. The styling arm carries on its outer side several shaping bodies arranged at a distance from each other, from the outer termination of the housing and, extending in the longitudinal direction.

6 Claims, 3 Drawing Sheets

HAIR STYLING DEVICE AND METHOD OF USE

CROSS REFERENCE APPLICATIONS

This application claims the benefit of German Application Number: 10 2013 107 778.1 filed Jul. 22, 2013.

BACKGROUND

The invention concerns a method of forming curls or waves of hair with a hair styling device having two articulated adjustable arms for receiving a strand of hair to be styled. Each arm has a shaping plate with a shaping surface that remains in contact with the strand of hair being styled during this process. By this method the hair being shaped is heated on the shaping plates and in this heated condition is drawn past at least one shaping body while making contact with it. Moreover, the invention concerns a hair styling device with two arms able to move against each other in the manner of a set of pliers. Each arm of which carries a shaping plate facing the other arm, especially to carry out the aforementioned method.

Hair curls or waves can also be shaped with a so-called straightening iron. Such a hair styling device is customarily used for straightening of hair and has two arms articulated against each other in the manner of a set of pliers. Each of these arms carries a shaping plate on its side facing the other arm. Normally, both shaping plates are heated with one or more electric heating elements. Typically PTC heating elements and/or a flow of hot air is used for the heating of a shaping plate. Between the shaping plates there is a hair styling space, which can be opened or closed due to the articulated arrangement of the arms. The shaping plates are outfitted with a level surface on their side facing the hair styling space. To straighten out hair, it is pulled through the closed hair styling space. The temperature supplied to the hair supports the smoothing process. Such hair styling devices are also used to form curls or waves. This is possible because the arms of such a hair styling device are approximately semicircular of semielliptical in cross section and the heated hair can be wound around the outer sides of the closed arms. In such a usage, the straightener is used in the manner of a curling iron. The outer sides of the arms then function as shaping bodies. However, it turns out that the curls or waves formed in this way only last for a short duration. In many cases after one or two hours they have already gone away.

Starting from this prior art, the problem of this invention is therefore to modify a method as mentioned at the outset for the shaping of curls or waves of hair, as well as an aforementioned hair styling device, so that the lifetime of the shaped curls or waves is substantially improved.

SUMMARY

This problem is solved by the invention of a method for forming curls or waves of hair with a hair styling device that has two articulated adjustable arms, each having a heated shaping plate with a shaping surface which is in contact with a strand of hair being shaped by the hair styling process. t. First the hair being styled is heated enough so that the sulfur bonds contained in the keratin chains of the hair are extensively broken up. The hair styling is then accomplished by pulling the heated hair past several shaping bodies, arranged at a distance from each other, while the hair remains in contact with the shaping bodies. Upon contacting the first shaping body the hair still has a temperature at which the sulfur bonds have not extensively joined together once more. The shaping bodies are arranged relative to each other so that the trajectory of movement of the hair being pulled past the shaping bodies corresponds to a curve, or approximately such. Before leaving the last hair shaping body the hair has cooled down to a temperature at which the broken sulfur bonds have extensively joined back together again.

In regard to the hair styling device, the problem is solved by the invention of a hair styling device with a hair styling device that has two articulated adjustable arms, each having a heated shaping plate with a shaping surface which is in contact with a strand of hair being shaped by the hair styling process, in which the arm with which the styling of curls or waves is done has on its outer side several shaping bodies extending in the longitudinal direction of the arm arranged with a spacing from each other and from the outer termination of the housing of that arm, and.

In this method, the hair is heated enough so that the sulfur bonds contained in the keratin chains and joining together the protein strands are extensively broken up. In this process, the hydrogen and salt bonds are also broken up since these are broken at lower temperatures than the sulfur bonds. In this condition, the hair is shaped, held in shape, and then cooled so that the altered shape of the hair is "frozen in". This is achieved in that the sulfur bonds reform during the shaping process and thus reconnect the protein strands according to the shaping of the hair. The hair is virtually quenched after its shaping because the hair being curled or waved is pulled past shaping bodies arranged such that upon leaving contact with the last shaping body in the pulling direction the hair has already cooled down to a temperature at which most of the sulfur bonds have reformed. It is not necessary for the hair to be cooled down to room temperature. Instead, it has been found surprisingly that a cool down to only a temperature at which the sulfur bonds are reconnected is sufficient to achieve a longer lasting hair styling than by traditional methods. The above described result was surprising, since the prevailing view assumed that a cool down of a curl shaped on a curling iron required a much lower temperature level in order to obtain the desired curling or waving. The fast cooling on the hair styling device that is used for the hair styling itself ensures that most of the sulfur bonds and preferably also the hydrogen and/or salt bonds have already reformed to freeze in the styling before the hair is again subjected to a tensile stress as a result of the pulling process needed to manipulate it. This unavoidable tensile stress on the styled hair is therefore without any significant influence on the styled hair. However, it has been found that to achieve a long-lasting curling or waving at least the sulfur bonds must be connected before the hair or the strand of hair leaves the at least one shaping body. In one preferred embodiment, however, the cool down of the shaped strand of hair on the at least one shaping body lasts long enough for the hydrogen and sulfur bonds to also be reconnected before the strand of hair leaves the at least one shaping body.

The method can be carried out with a hair styling device which has only a single shaping body. In theory, this could be the outer side of the housing of an arm of a hair styling device designed as a straightening iron. In any case, one must make sure that the cool down occurs to a sufficient degree before the hair strand loses contact with the shaping body. Finally, the hair strand should be in a curled position when sulfur bonds joining the keratin chains are broken up and before they are reconnected, so that a greater tensile stress prevails on the outer sides of the hair making up such a strand than on the inner sides.

In order to make possible an effective and thus rapid cool down of the styled hair, the shaping bodies of the claimed hair styling device are spaced apart from each other in relation to the trajectory of movement of the hair moving past and in contact with them. This makes possible a dissipation of heat from the hair in the radial direction in relation to the curved path traveled by the hair to the outside and in the gaps between the shaping bodies and also inward in the direction of the arms carrying the shaping bodies. Thus, the shaping bodies form supports past which the heated hair is pulled. Accordingly, the hair is free hanging between the shaping bodies serving as supports and does not lie against the surface of a body. The trajectory of the hair starting from the exit of the hair styling gap and until leaving contact with the last shaping body constitutes the curve. Depending on the shape of the curve, i.e., depending on the arrangement of the shaping bodies to each other, a larger or smaller curl can be formed. The curve is also influenced by the number of shaping bodies provided. By pulling the hair being styled past the shaping body while in contact with it, the hair is held in the desired shape as the pulling continues until the cool down process has advanced so far that at least most of the sulfur bonds have reformed thereby fixing the shape.

In one simple embodiment of a hair styling device to carry out the above-described method, the edge of the arm adjoining the shaping plate can also serve as a shaping body on the side where the heated hair emerges from the hair styling gap. This edge is advisedly rounded. Then only one additional shaping body is needed in order to style the hair in the described manner and keep it at a distance from the housing of the arm. However, it is advisable that several shaping bodies be used, typically three to five, for a better and longer formation of the curved path. It is entirely possible to use the described edge of the arm likewise as a shaping body in the above described manner.

Preferably the method will be designed so that the hair has cooled down by at least 10° C. upon leaving the last shaping body, and most preferably by even more than 15° C. to 20° C. below the temperature at which the sulfur bonds contained in the keratin chains of the hair are broken. Depending on the texture of the hair being styled, this temperature can be regulated by a heating adapted to the texture or the hair and/or the speed of the pulling with which the hair styling device is moved through the hair. The process can also be influenced through the pressure exerted on the hair situated in the hair styling gap between the two shaping plates of the arms.

A current of air can serve to support the cool down. A cool down of the hair is especially effective if the shaping bodies are only supported at single points and thus there is a free space on the side of the shaping body facing the arm. This not only accomplishes a cool down of the hair through the shaping bodies, which can give off heat in this direction, but also an air exchange in the region between the hair being moved around this arm of the hair styling device or the strand of hair being moved around this arm of the hair styling device and the outside of the housing itself. The pulling process itself ensures a swirling of the air and thus an air exchange between the hair and the outside of the arm carrying the shaping body. This air swirling takes away the heat given off by the hair and supplies cool room air to it.

According to one sample embodiment, the shaping bodies are configured as rods.

Basically, the shaping bodies can have a different cross sectional geometry in the pulling direction of the hair, especially if they border on a free space on their side facing the arm. Thus for example, the last shaping body in contact with the hair can have a larger contact surface with the hair in order to produce a last negative temperature swing by abstraction of heat. Such a shaping body also advisedly has a relatively larger heat transfer surface, such as in the manner of one or more cooling fins. Typically at least the first shaping body or bodies are designed and arranged so that the hair, moving past them in contact with them, has not yet cooled below the temperature at which the sulfur bonds have reformed in order to reconfigure the keratin chains in accordance with the desired styling.

The invention shall be described below by means of sample embodiments, making reference to the enclosed figures. There are shown:

DETAILED DESCRIPTION OF THE DRAWINGS

Figure 1:
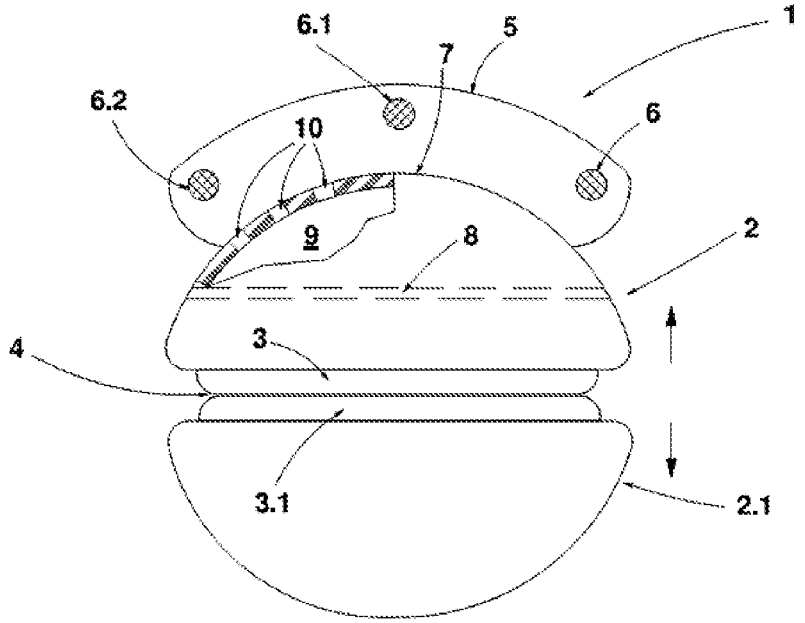
FIG. 1 is a schematic end face view of a hair styling device according to the invention.

A hair styling device 1 comprises two hinged arms 2, 2.1 movable relative to each other in the manner of a set of pliers. FIG. 1 shows the two arms 2, 2.1 of the hair styling device 1 in their closed position. Each arm 2, 2.1 has on its side facing the other arm 2.1 or 2 a shaping plate 3, 3.1. The shaping plates 3, 3.1 are heated in a manner not otherwise described. For example, they could be heated by means of one or more PTC heating elements which could be actuated independently of each other. Between the facing surfaces of the shaping plates 3, 3.1 is a hair styling gap 4, in which the hair is received for styling. In order to receive the hair, the arms 2, 2.1 are moved away from each other to open the hair styling gap 4, as indicated by the arrows in FIG. 1. Accordingly, the hair styling device 1 as described above is a familiar straightening iron. The hair styling device 1 can also be used as such. Once received in the region of the hair roots, the hair being straightened is pulled between the two arms 2, 2.1 through the closed hair styling gap 4 when the shaping plates 3, 3.1 are heated. The heat transferred to the hair being styled supports the hair styling process.

However, the hair styling device 1 is particularly suitable for the forming of especially long-lasting curls or waves. For this purpose, the arm 2 carries three shaping bodies 6, 6.1, 6.2, each held at their ends joined to a trestle 5, 5.1 as rods with circular cross section geometry. The shaping bodies 6, 6.1, 6.2 in the depicted embodiment shown are metal rods. As can be seen from FIG. 1, the shaping bodies 6, 6.1, 6.2 are arranged at a distance from each other and at a distance from the housing 7 of the arm 2 carrying the trestles 5, 5.1.

The arm 2 is divided by a partition wall 8 installed therein (broken line) and has a flow chamber 9. In the handle of the hair styling device 1, not shown more closely, there is a fan which provides a current of air when in operation. This current of air is directed into the flow chamber 9. In the region of the shaping body 6.2, exit openings 10 are made in the housing 7 in the manner of a grid, following the lengthwise dimension of the arm 2. The current of air from the arm 2 is directed through the exit openings 10 into the flow chamber 9.

Figure 2:
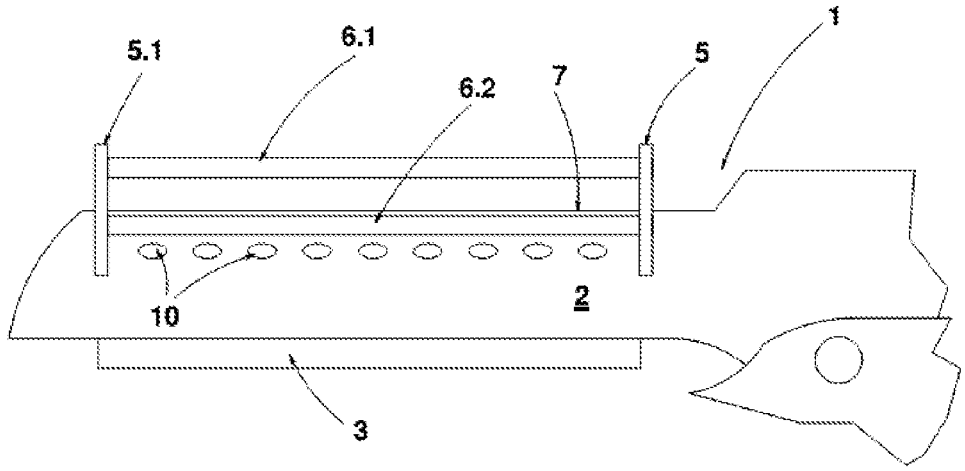
FIG. 2 is a schematic partial side view of the hair styling device of FIG. 1.

FIG. 1 shows the shaping bodies 6, 6.1, 6.2 in a cross section, looking at the end face of the arm 2 just behind the trestle 5.1 arranged at the end face (also see FIG. 2).

The heating power of the one or more heating elements heating the shaping plates 3, 3.1 is high enough to bring the hair led through the hair styling gap 4 up to a temperature above which the sulfur bonds contained in the keratin chains of the hair are broken. This process will be different from one type of hair to another. In the case of hair which is more fine and thin, this temperature lies at a lower level than in the case of thicker hair. At around 140° C. the sulfur bonds begin to break. Typically a heating of the hair is done to a temperature which is slightly higher than the temperature needed to break the sulfur bonds. So as not to stress the hair needlessly, the heating power for heating the shaping plates can be adjusted. This is so a temperature of around 10° C. to 20° C. above the sulfur bond breaking temperature prevails at the hair styling surfaces of the facing shaping plates 3, 3.1. In the method for curling or waving of hair that is carried out with the hair styling device 1, the hair is brought up to such a temperature in order to achieve a more long-lasting shaping of the hair before it has cooled down enough for the sulfur bonds to reform again. This reforming occurs in a condition in which the hair is held in the desired curly shape. If the hair has reached a temperature below the temperature needed for the breaking of the sulfur bonds, the sulfur bonds reform and hold the hair in the desired curl. Thus, the hair leaves the hair styling device 1 only if the sulfur bonds contained in the keratin chains have at least mostly reformed in it.

Figure 3:
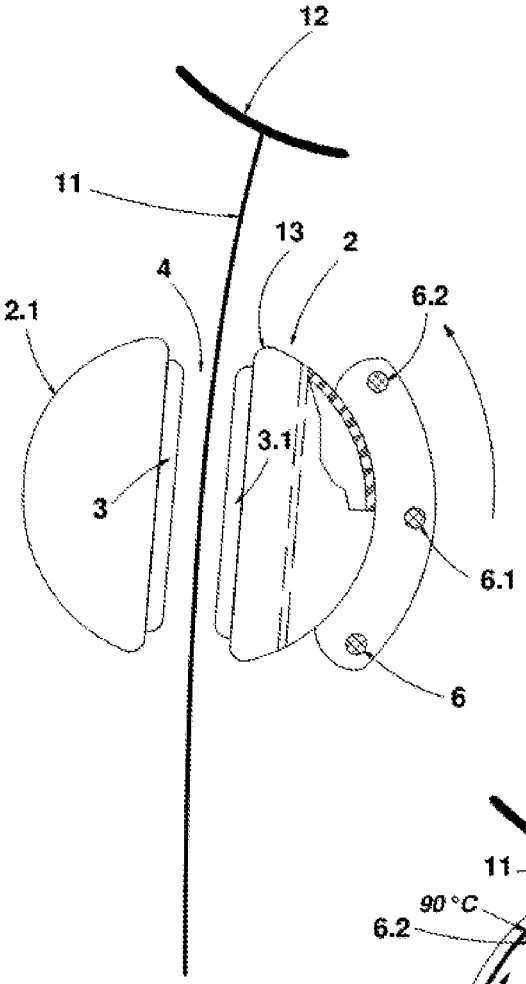
FIG. 3 shows the hair styling device of FIGS. 1 and 2 during the process of receiving the hair to carry out a hair styling.

In order to describe the hair styling process with the hair styling device 1, the hair styling method shall be described in further detail below with reference to FIGS. 3 and 4. FIG. 3 shows the hair styling device 1 with open arms 2, 2.1. A strand of hair 11 is taken up into the hair styling gap 4 located between the shaping plates 3, 3.1. The scalp is indicated by reference symbol 12 in the figures. After introducing a strand of hair 11 into the hair styling gap 4, the arms 2, 2.1 are closed, so that the shaping surfaces of the shaping plates 3, 3.1 lie against the strand of hair 11. This typically occurs with a certain pressing force. The hair styling device can be designed so that when the user reaches a particular pressing force this is shown by an indicator device, such as by a vibrator device or the like. Such a pressure metering device can help ensure a sufficient heat transfer from the heated shaping plates 3, 3.1 to the strand of hair 11. The heat transfer to the strand of hair depends on the pressing force. Thus, with such a pressure metering device one can ensure a better uniformity over the course of the shaping process of a strand of hair 11 and other strands of hair. The facing shaping surfaces of the shaping plates 3, 3.1 are heated in the sample embodiment shown up to a temperature of around 170° C. This and the following temperature indications should be taken as examples, as they illustrate the principle of the temperature management in the styling with the hair styling device 1 to form curls or waves. The hair brought together in the strand 11 is of such a nature that the sulfur bonds in the keratin chains break at around 140° C.

Figure 4:
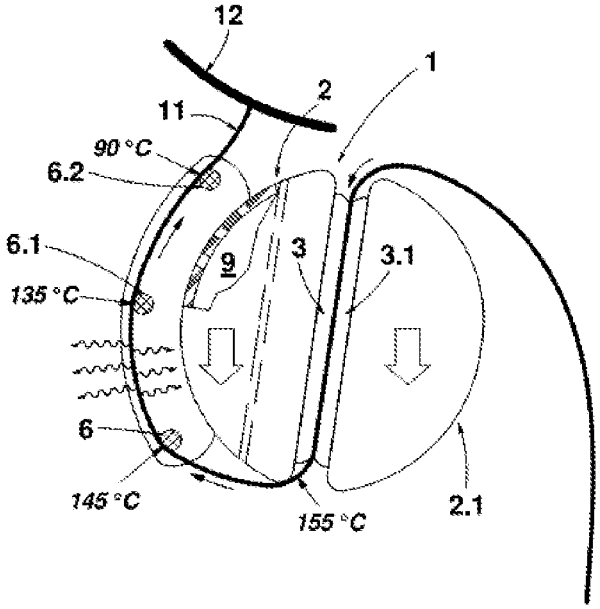
FIG. 4 shows the hair styling device of FIG. 3 while performing the hair styling process.

After closing the hair styling gap 4 and grasping the strand of hair 11, the hair styling device 1 is turned counterclockwise so that the strand of hair is laid around the lower edge 13, as shown by an arrow in FIG. 3 and then around the shaping bodies 6, 6.1, 6.2, as is shown in FIG. 4. The lower edge 13 runs parallel to the longitudinal dimension of the shaping plate to 3, FIG. 4 shows the hair styling device at the beginning of the hair styling process. The process commences when the hair styling device 1, as indicated by the block arrows in FIG. 4, is pulled away from the scalp 12. In the course of this movement, the strand of hair 11 is successively pulled into the hair styling gap 4 and heated therein. At the exit of the hair styling gap 4 located between the shaping plates 3, 3.1, the strand of hair 11 in the depicted embodiment has a temperature of around 155° C. In this condition the hair, in which the sulfur bonds contained in the keratin chains are at least mostly broken, is pulled across the edge 13 and then across the shaping bodies 6, 6.1, 6.2. The shaping bodies 6, 6.1, 6.2 are arranged to describe a curved trajectory, on which the strand of hair 11 is moved in the aforementioned process of moving the hair styling device 1 relative to the scalp 12. It is important here that a greater tensile stress is present on the individual hairs of the strand of hair 11 on the outer side than on the inner side, facing the housing 7.

At the shaping body 6 the hair in the strand of hair 11 still has a temperature of around 145° C. At the shaping body 6.1, a temperature of around 135° C. still prevails. The strand of hair 11 is held in shape at the shaping bodies 6, 6.1 on the curved path shown in FIG. 4 and increasingly cools down. The cool down is completed on the section up to the shaping body 6.1 solely by surrendering heat in the radial direction outward and inward, which is indicated by the wavy arrows. Therefore, the strand of hair 11 cools down as it is moved successively across the shaping bodies 6, 6.1. Upon falling below a certain temperature, in the depicted embodiment around 140° C., the sulfur bonds in the keratin chains begin to reform, so that as a result the keratin chains link up in the form in which the strand of hair 11 has been laid across the shaping bodies 6, 6.1, 6.2. Thus, the mostly straight keratin chains in the case of straight hair are reformed into curved keratin chains.

To support the cool down process, in the depicted embodiment shown the flow channel 9 receives a current of air from a fan. This flow emerges from the exit openings 10, and the strand of hair 11 is cooled more intensely on its path from the shaping body 6.1 to the shaping body 6.2 than on the section from the shaping body 6 to the shaping body 6.1. Thanks to the current of air acting on the strand of hair 11 in the region of the shaping body 6.2, the strand of hair is cooled down to around 90° C. This means that the strand of hair 11 for the entire period of time during which the broken sulfur bonds are reforming is held in shape by the shaping bodies 6, 6.1, 6.2 or with tensile stress in the individual hairs at their outer radial side, and the strand of hair 11 leaves the shaping body 6.2 only at a temperature which ensures that all or most of the sulfur bonds have reformed.

In the context that the strand of hair 11 is held by the shaping bodies 6, 6.1, 6.2 in curvature or under tensile stress at the outer side, longer sulfur bonds are formed at the outer curvature side of the individual hairs than at the inner curvature side, which is the basis for the curvature of the keratin chains and therefore also the curvature of the styled hair. This is also responsible for the improved lifetime of the hair styling.

The movement of the hair styling device 1 and the spacing of the shaping bodies 6, 6.1, 6.2 from the housing 7 ensures an effective cool down of the strand of hair 11 on a relatively short movement path, while the movement of the hair styling device 1 supports an air exchange on the side pointing from the strand of hair 11 to the housing 7.

In the depicted embodiment shown, the hair styling device 1 has been described with a flow channel 9 and additional cooling support by a fan. The hair styling principle described above can also be implemented even without such an additional cooling air current.

Figure 5:
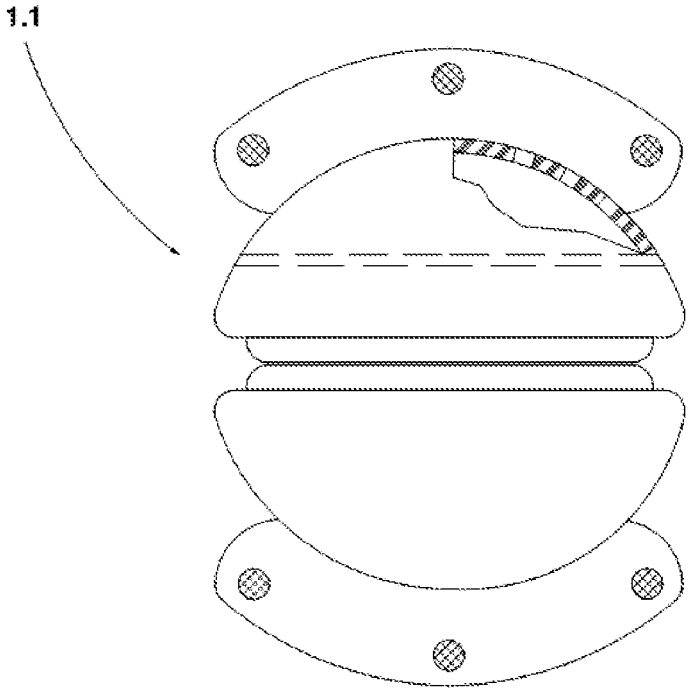
FIG. 5 shows a hair styling device according to another embodiment of the invention.

FIG. 5 shows another hair styling device 1.1 according to the invention. In the depicted embodiment shown in FIG. 5, the two arms of the hair styling device 1.1 are outfitted with shaping bodies, as described for the hair styling device 1. In the hair styling device 1.1, the shaping bodies of both arms can be used, so that starting from a hair receiving position as described for the hair styling device 1 in FIG. 3 it can be rotated both counterclockwise and clockwise into the pulling position. Therefore, the remarks describing the arm 2 of the hair styling device 1 with its shaping bodies 6, 6.1, 6.2 also apply to the second arm of the hair styling device 1.1 outfitted with such shaping bodies The invention has been described by means of sample embodiments. Without leaving the scope of the applicable claims, numerous other configurations will emerge to the skilled person, which can implement the invention.

LIST OF REFERENCE SYMBOLS

1, 1.1 Hair styling device
2, 2.1 Arm
3, 3.1 Shaping plate
4 Hair shaping gap
5, 5.1 Trestle
6, 6.1, 6.2 Shaping body
7 Housing
8 Partition wall
9 Flow chamber
10 Exit opening
11 Hair strand
12 Scalp
13 Edge

The invention claimed is:

1. A method for forming curls or waves of hair with a hair styling device:

providing a hair styling device having two articulated, adjustable arms for receiving a strand of hair being styled, each arm comprising an inner surface and an opposing outer surface wherein the inner surfaces of the arms face one another and the outer surfaces, the inner surfaces of each arm comprise a shaping plate with a heated shaping surface and one of the arms provides several shaping bodies attached to the outer surface thereof in a spaced apart manner such that a free space exists between the outer surface of the arm and a surface of each shaping body facing the arm, wherein the shaping bodies extend longitudinally along a length of the arm and are arranged spaced apart relative to each other to form a curved trajectory;

inserting a strand of hair between the two arms and pressing the arms toward each other to bring the strand of hair into contact with the heated shaping surfaces and heating the strand of hair to a temperature at which the sulfur bonds contained in the keratin chains of the hair are broken up;

pulling the hair styling device in a direction away from the scalp whereby the heated portion of the strand of hair exiting the hair styling device is pulled over the several spaced apart shaping bodies thereby bring the strand of hair in its desired form;

upon the heated portion of the strand of hair exiting the hair styling device and contacting a first of the shaping bodies, the heated portion of the strand of hair is at a temperature at which the broken up sulfur bonds have not joined together;

the trajectory of movement of the heated portion of the strand of hair being pulled past the shaping bodies corresponds to the curved trajectory and before leaving the last hair shaping body the hair has cooled down to a temperature at which the broken sulfur bonds have joined back together.

2. The method of claim 1, wherein a cool down of the hair occurs by surrendering heat to the surroundings in the direction away from the arm and in the direction toward the arm along the curved trajectory.

3. The method of claim 1, wherein the hairstyling device includes a fan and the arm having the plurality of shaping bodies includes at least one opening where a current of air generated by the fan exits through the opening to cool the hair or to support the cooling process.

4. The method of claim 1, wherein the hair upon leaving the last shaping body has cooled down to a temperature which is at least 10° C. below the temperature needed for breaking the sulfur bonds in the keratin chains of the hair.

5. The method of claim 4, wherein the hair upon leaving the last shaping body has cooled down to a temperature of at least 15° C. below the temperature needed for breaking the sulfur bonds in the keratin chains of the hair.

6. The method of claim 4, wherein the hair upon leaving the last shaping body has cooled down to a temperature of at least 20° C. below the temperature needed for breaking the sulfur bonds in the keratin chains of the hair.

* * * * *